US009925820B1

(12) United States Patent
Dennis et al.

(10) Patent No.: US 9,925,820 B1
(45) Date of Patent: Mar. 27, 2018

(54) GREETING CARD WITH INFLATABLE BALLOON

(71) Applicant: American Greetings Corporation, Cleveland, OH (US)

(72) Inventors: Erin Dennis, Lakewood, OH (US); Ken Gilroy, Berea, OH (US); John Talbot, Bay Village, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/477,143

(22) Filed: Apr. 3, 2017

(51) Int. Cl.

| | |
|---|---|
| ***G09F 21/06*** | (2006.01) |
| ***B42D 15/04*** | (2006.01) |
| ***B42D 15/02*** | (2006.01) |
| *A63H 27/10* | (2006.01) |

(52) U.S. Cl.
CPC ..... *B42D 15/045* (2013.01); *B42D 15/027* (2013.01); *A63H 2027/1033* (2013.01); *A63H 2027/1058* (2013.01); *A63H 2027/1075* (2013.01); *B42D 15/022* (2013.01)

(58) Field of Classification Search
CPC ..... A63H 27/10; A63H 2027/1033; B42D 15/045; B42D 15/042; G09F 1/06; G09F 1/10; G09F 23/00; G09F 3/20
USPC ..... 40/124.03–124.06; 446/71–75
See application file for complete search history.

(56) References Cited

U.S. PATENT DOCUMENTS

| | | | | |
|---|---|---|---|---|
| 2,231,785 | A | 2/1941 | Wendling | |
| 4,813,902 | A | 3/1989 | Messer | |
| 5,009,624 | A | 4/1991 | Estam-Goggin | |
| 5,083,961 | A * | 1/1992 | Ishiwa | A63H 3/06 428/15 |
| 5,573,437 | A | 11/1996 | Van Dyke | |
| 5,819,448 | A | 10/1998 | Kieves et al. | |
| 5,852,889 | A | 12/1998 | Rinaldi | |
| 6,158,588 | A | 12/2000 | Conti | |
| 8,341,858 | B2 * | 1/2013 | Clegg | B42D 15/022 40/124.03 |
| 2007/0249259 | A1 | 10/2007 | Pham | |

FOREIGN PATENT DOCUMENTS

| | | |
|---|---|---|
| WO | 2005103557 | 11/2005 |

* cited by examiner

*Primary Examiner* — Shin H Kim
(74) *Attorney, Agent, or Firm* — Christine Flanagan

(57) ABSTRACT

A greeting card having a greeting card body and an interactive element which includes a mechanical balloon attached to the greeting card body which is operative to move from a flat positon to an inflated position by the operation of a mechanical spring mechanism contained in an interior cavity of the balloon. The greeting card also has audio capabilities wherein a sound module is operative to store and playback at least one audio file upon interaction with a user.

19 Claims, 8 Drawing Sheets

GREETING CARD WITH INFLATABLE BALLOON

RELATED APPLICATIONS

There are no applications related to this application.

FIELD OF THE INVENTION

The present invention is in the field of social expression products, such as greeting cards. More specifically the present invention is directed to a greeting card having an inflatable balloon.

SUMMARY OF THE INVENTION

One embodiment of the present disclosure and related inventions includes a multi-panel greeting card body, a sound module contained inside the multi-panel greeting card body, the sound module operative to store and playback at least one audio file, a mechanical balloon which is operative to move from a flat position to an inflated position and a switch which controls activation of the sound module and movement of the mechanical balloon.

Another embodiment of the present disclosure and related inventions includes a greeting card body, a balloon attached to the greeting card body, a mechanical mechanism located in an interior cavity of the balloon, the mechanical mechanism operative to move from a flat position to an upright position wherein it pushes outward on a front face of the balloon, and a switch which controls movement of the mechanical mechanism from the flat position to the upright position and back to the flat position.

In yet another embodiment of the present disclosure and related inventions, a greeting card includes a multi-panel greeting card body, a balloon attached to the multi-panel greeting card body, a mechanical spring located in an interior cavity of the balloon, the mechanical spring capable of moving from a first, substantially flat position to a second, upstanding position, and a switch which controls movement of the mechanical spring, wherein closing the switch causes the mechanical spring to move from the first, substantially flat positon to the second upstanding position within the interior cavity of the balloon, thereby simulating inflation of the balloon.

DETAILED DESCRIPTION OF PREFERRED AND ALTERNATE EMBODIMENTS

One embodiment of the present disclosure and related inventions includes a greeting card 100 with inflatable balloon 12 attached thereto with associated audio.

Figure 1:
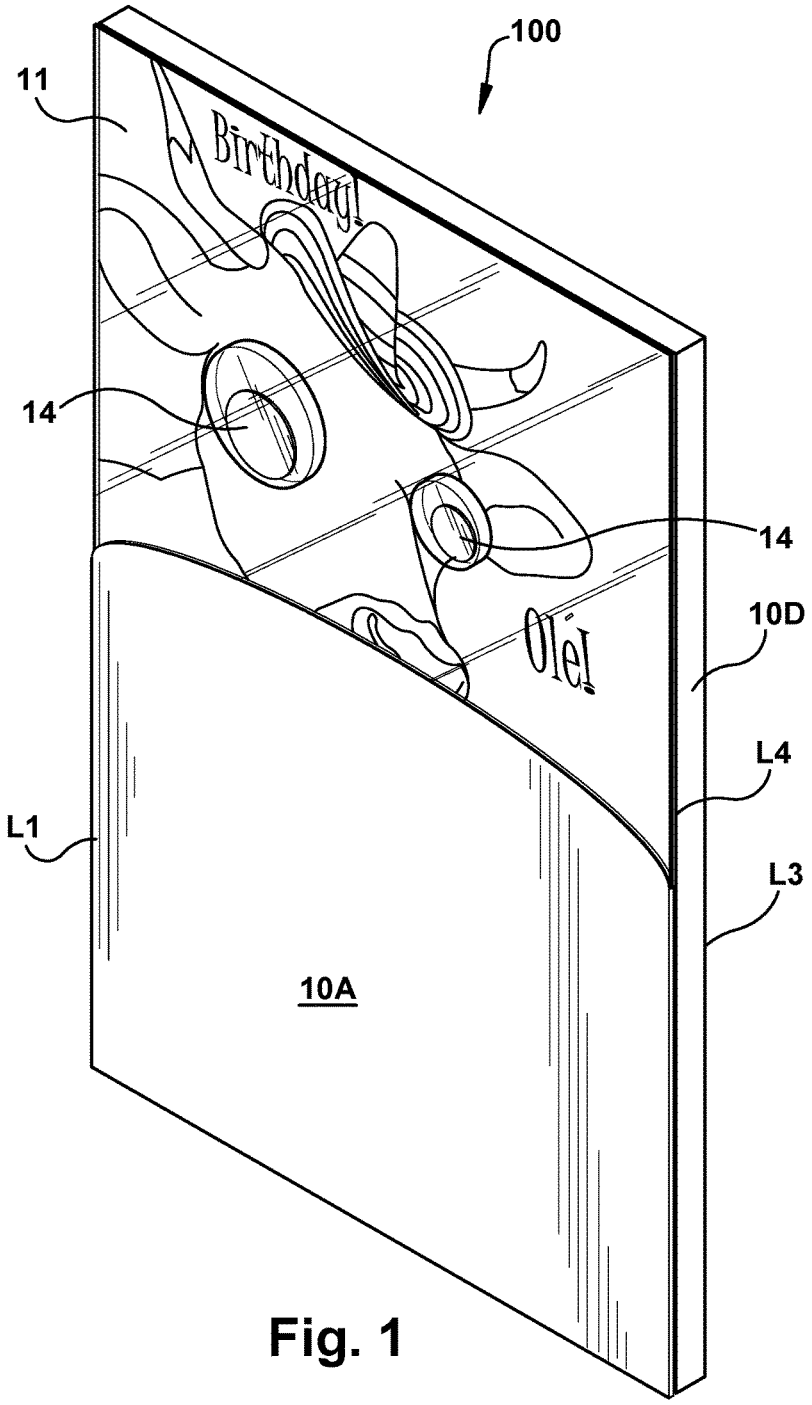
FIG. 1 is a perspective view of the GREETING CARD of the present invention, in a closed position.

A greeting card body 10 contains multiple greeting card panels attached along various vertical fold lines. An inner frame structure located between at least two panels of the greeting card body 10 creates a cavity wherein various electronic and/or mechanical components of the greeting card 100 are inserted. The frame structure is substantially rectangular in shape with two opposing vertical sides connected by two opposing horizontal sides creating a substantially rectangular shape with the two vertical sides being longer than the two horizontal sides. The frame structure, in one embodiment, is made of foam but can be made of other materials such as cardboard, corrugate, paperboard, plastic, etc. The multi-panel greeting card body 10 contains several panels which wrap around to conceal and enclose the frame structure and electronic and/or mechanical components located within the cavity between the frame. Each panel of the multi-panel greeting card body 10 contains a front surface and a rear surface opposite the front surface. In one embodiment, the panels of the multi-panel greeting card body 10 are made of paperboard, although other materials can be used. A first main panel 10A is attached along a first vertical fold line L1 to a first side tab panel 10B. The first side tab panel 10B is attached to a second main panel 10C along a second vertical fold line L2. The second main panel 10C is attached to a second tab panel 10D along a third vertical fold line L3. The second tab panel 10D is attached to a third main panel 10E along a fourth vertical fold line L4. The third main panel 10E is attached to a third tab panel 1OF along a fifth vertical fold line L5. The frame structure of the greeting card 100 is covered by second and third main panels 10C, 10E and the second and third tab panels 10D, 10F. The first main panel 10A and tab panel 10B are folded on the left side (first tab panel 10B) and front face (first main panel 10A) of the covered frame structure. The outer surface of the first main panel 10A serves as the front cover of the greeting 100 and the inner surface of the first main panel 10A serves as the inside left panel of the greeting card 100. The third main panel 10E (which covers the front surface of the frame structure) serves as the inside right panel of the greeting card 100 and the second main panel 10C (which covers the rear surface of the frame structure) serves as the rear or back panel of the greeting card 100. The first tab panel 10B and the first main panel 10A (which serves as both the front cover (outer surface) and the inside left panel (inner surface)) are shorter in length than the frame structure, second and third main panels 10C, 10E and second and third tab panels 10D, 10F. Due to the shorter length, at least a portion of the third main panel 10E (which serves as the inside right panel of the greeting card 100) is visible from the front of the greeting card 100 when the greeting card 100 is in a closed position, as shown in FIG. 1. The greeting card 100 may additionally contain a transparent upper panel 11 which can be attached to the top edge of the first main panel 10A. The transparency still allows for a portion of the third main panel 10E to be visible from the front of the greeting card 100 when the greeting card 100 is in a closed position. The greeting card 100 is considered to be in a closed position when the inside left panel 10A of the greeting card 100 is facing and in contact with the inside right panel 10E of the greeting card 100. Opening the greeting card 100 requires moving the front panel 10A in an outward direction by pivoting the front panel 10A about the first and second vertical fold lines L1, L2 to reveal the inside right panel 10E of the greeting card 100. Each of the main and tab panels of the multi-panel greeting card body 10 may have printing thereon which includes, but is not limited to: photos, pictures, drawings, text sentiment, or any other printed matter. These panels may also include additional embellishments which can be attached thereto such as googly eyes, gems, faux fur, or any other such embellishment. In one embodiment, a picture of an animal is printed on the third main greeting card panel 10E and a pair of googly eyes 14 is attached thereto. At least a portion of the picture and googly eyes 14 are visible from the front of the greeting card 100 when the greeting card is 100 in a closed position due to the shorter nature of the front or first main greeting card panel 10A (and optional transparent upper panel 11), as shown in FIG. 1.

Figure 4:
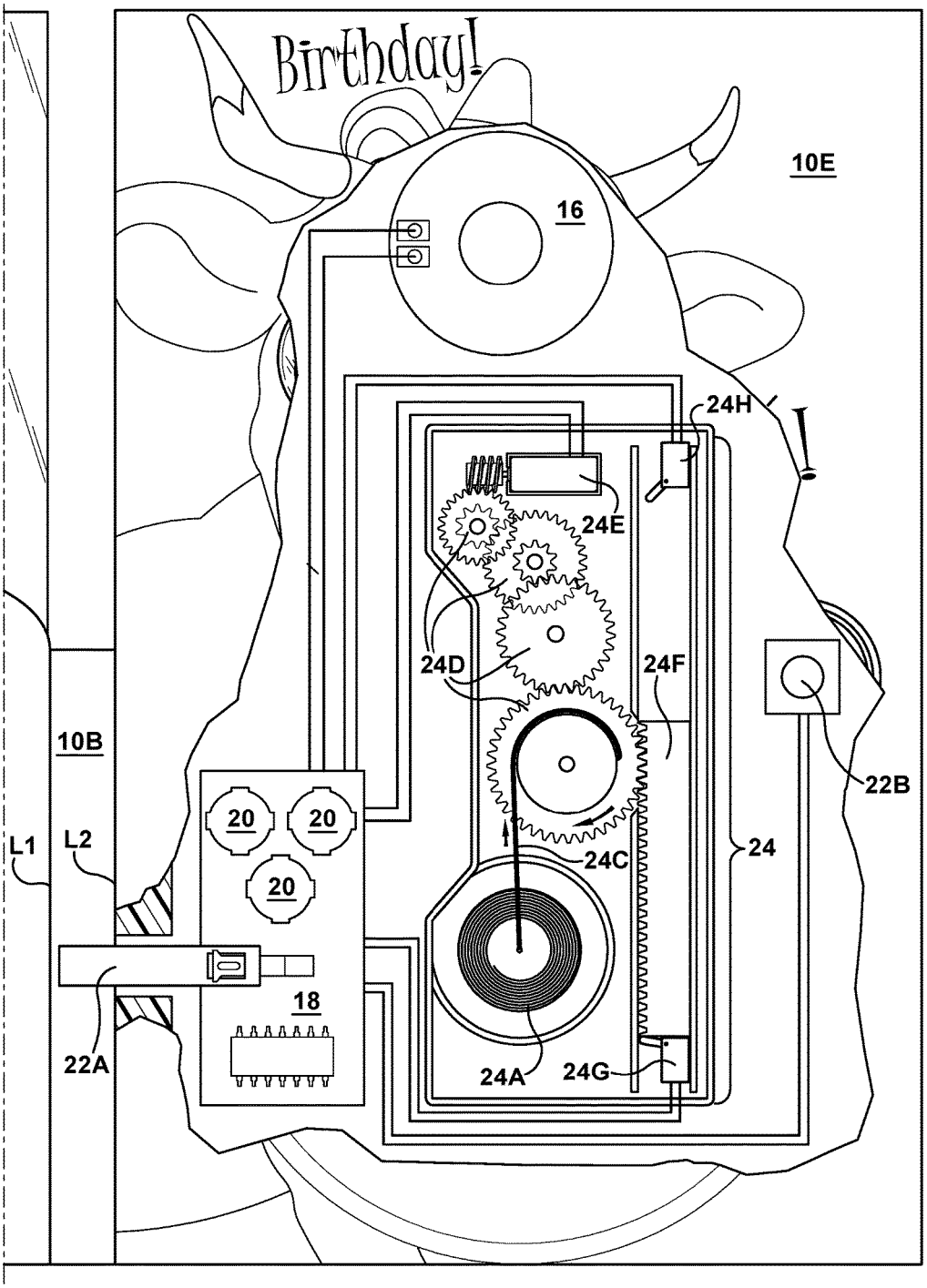
FIG. 4 is a front tear away view of the GREETING CARD of FIG. 1, with gears, string and sliding mechanism in a first position.
Figure 5:
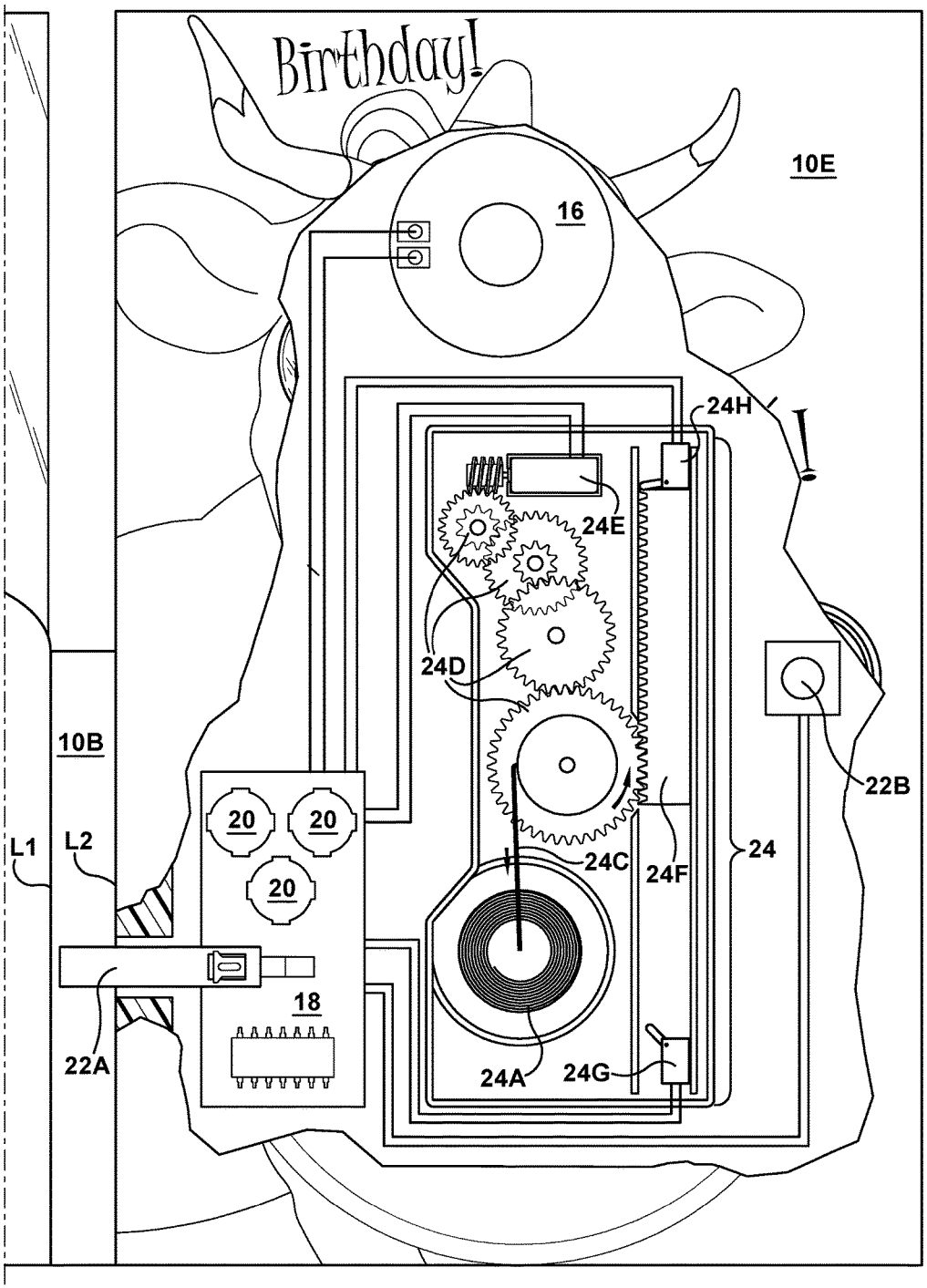
FIG. 5 is a front tear away view of the GREETING CARD of FIG. 1, with gears, string and sliding mechanism in a second position.

A sound module is contained within the cavity between the frame structure and beneath the second and third main greeting card panels 10C, 10E and second and third tab panels 10D, 10F. The sound module is operative to store and playback at least one audio file saved thereon through a speaker 16. The sound module may include, but is not limited to: a printed circuit board 18, an integrated circuit chip, a power source 20, a speaker 16, a memory storage device, one or more audio files stored thereon, a switch 22 and related wiring and circuitry. Any other component which is required to or which facilitates storage of one or more audio file and playback of said one or more audio file through a speaker 16 may be included as well. These components are readily known to one having ordinary skill in the art and will not be discussed in further detail herein. A first switch 22A controls activation of the sound module and in one embodiment, is a slide switch 22A which is located over the second vertical fold line L2 which connects the first tab panel 10B to the second main panel 10C of the greeting card body 10, as shown in FIGS. 4 and 5. This location allows for activation of the sound module upon opening the greeting card 100 as the slide tongue is pulled outward upon opening the greeting card by moving the front panel (first main panel) 10A of the greeting card 100 outward and to the left (away from the second and third main panels 10C, 10E) thereby completing the circuit and triggering playback of the saved audio file through the speaker 16. The audio clip played when opening the greeting card 100 may instruct the user in how to cause inflation of the balloon 12. In addition to replaying an audio clip upon opening the greeting card 100 in response to the slide switch 22A, the sound module also replays an audio clip upon initiating inflation of the balloon 12 attached to the greeting card body 10, which is described in further detail below. While a slide switch has been described herein and shown in the figures with respect to one embodiment, other types of switches may be used, including, but not limited to: a touch sensitive switch; a light sensitive switch; a motion sensitive switch; a contact switch; a push button switch; a toggle switch; a selector switch; a magnetic switch; or any other suitable switch mechanism.

A miniature balloon 12 is attached to the multi-panel greeting card body 10. In one embodiment, the balloon 12 is attached to the third main panel 10E of the greeting card 100 (the inside right panel). The shorter front or cover panel (first main panel) 10A completely covers the balloon 12 when the greeting card 100 is in a closed position (shown in FIG. 1) so that the balloon 12 is a surprise to the greeting card recipient upon opening the greeting card 100. In one embodiment, the balloon 12 is a miniature Mylar balloon, although other balloon materials may be used, including but not limited to: rubber, latex, nylon, etc.

Figure 8:
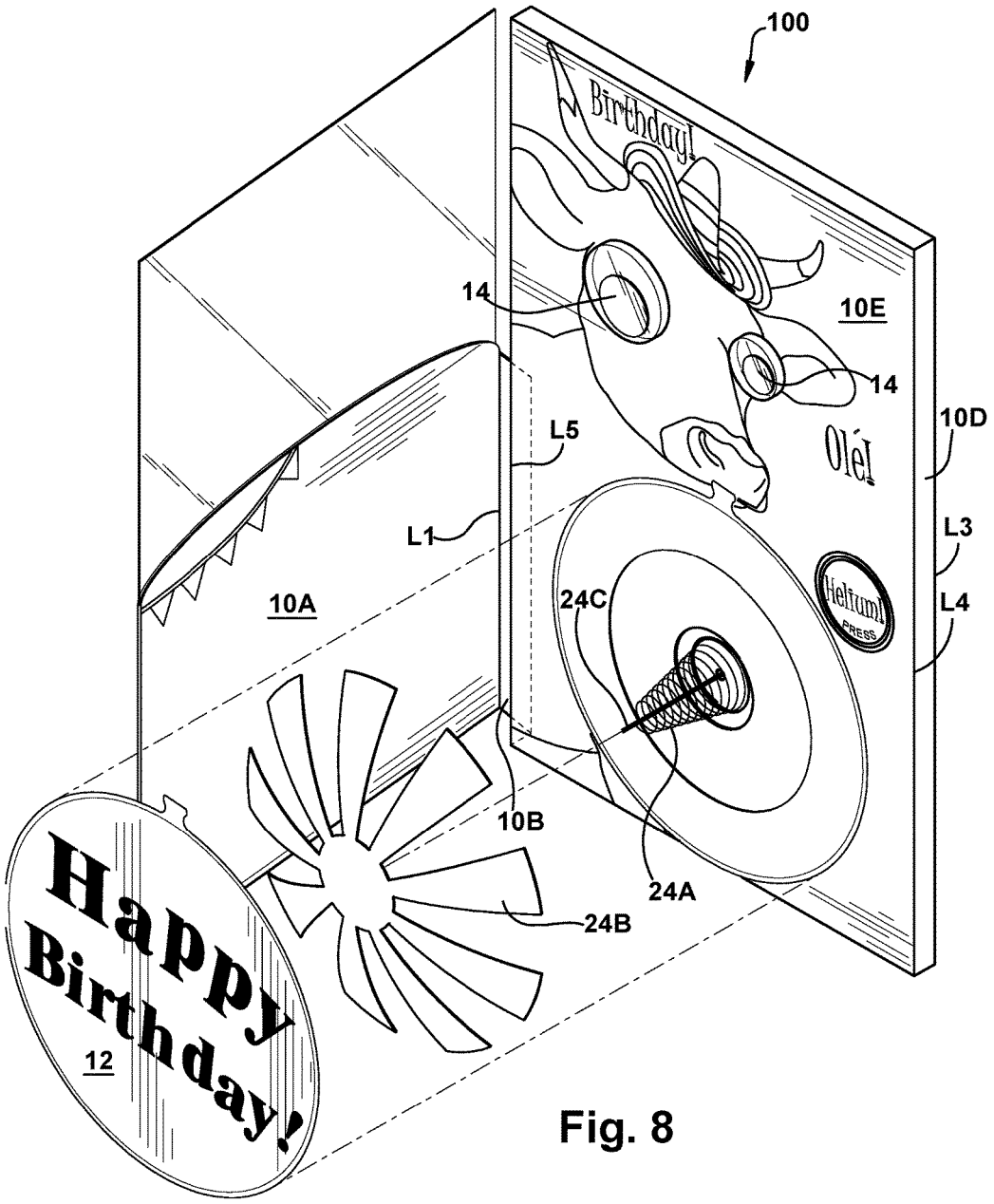
FIG. 8 shows an exploded view of the balloon which is attached to the GREETING CARD of FIG. 1.

A mechanical spring mechanism 24 is used to move the balloon to move between a first or deflated position and a second or inflated position to simulate the inflation and deflation of a balloon by, for example, air or helium. The mechanical spring mechanism includes a cone shaped spring 24A, a die cut shape 24B, a string 24C, one or more gears 24D, a motor 24E, a sliding mechanism 24F, and two lever switches 24G, 24H. The one or more gears 24D, motor 24E, sliding mechanism 24F, two lever switches 24G, 24H and a second end of the string 24C are located within a cavity in the greeting card body 10. The cone shaped spring 24A, die cut shape 24B and first end of the string 24C are also contained within the cavity in the greeting card body 10 but also extend into a cavity or interior of the balloon 12. The die cut shape 24B contains a first circular base shape which is attached to the top surface of the cone shaped spring 24A, and a second shape attached to the top of the first circular base shape, which contains a circular shape in the center with a plurality of cone shaped extensions extending outward therefrom (resembling a sunshine shape). The die cut shape 24B is similar in size to the balloon 12 but slightly smaller so that it can fit therein, as shown in FIG. 8. It is used inflate of the balloon 12 by pushing outward across an interior front face of the balloon 12. The first and second ends of the string 24C are connected between the top of the spring 24A and the one or more gears 24. The string 24C runs from above the die cut shape 24B through the center of the cone shaped spring 24A and then it is attached to the one or more gears 24D, as shown in FIGS. 4 and 5. A second switch 22B controls activation of the motor 24E. In one embodiment, the second switch 22B is a push button switch.

Figure 2:
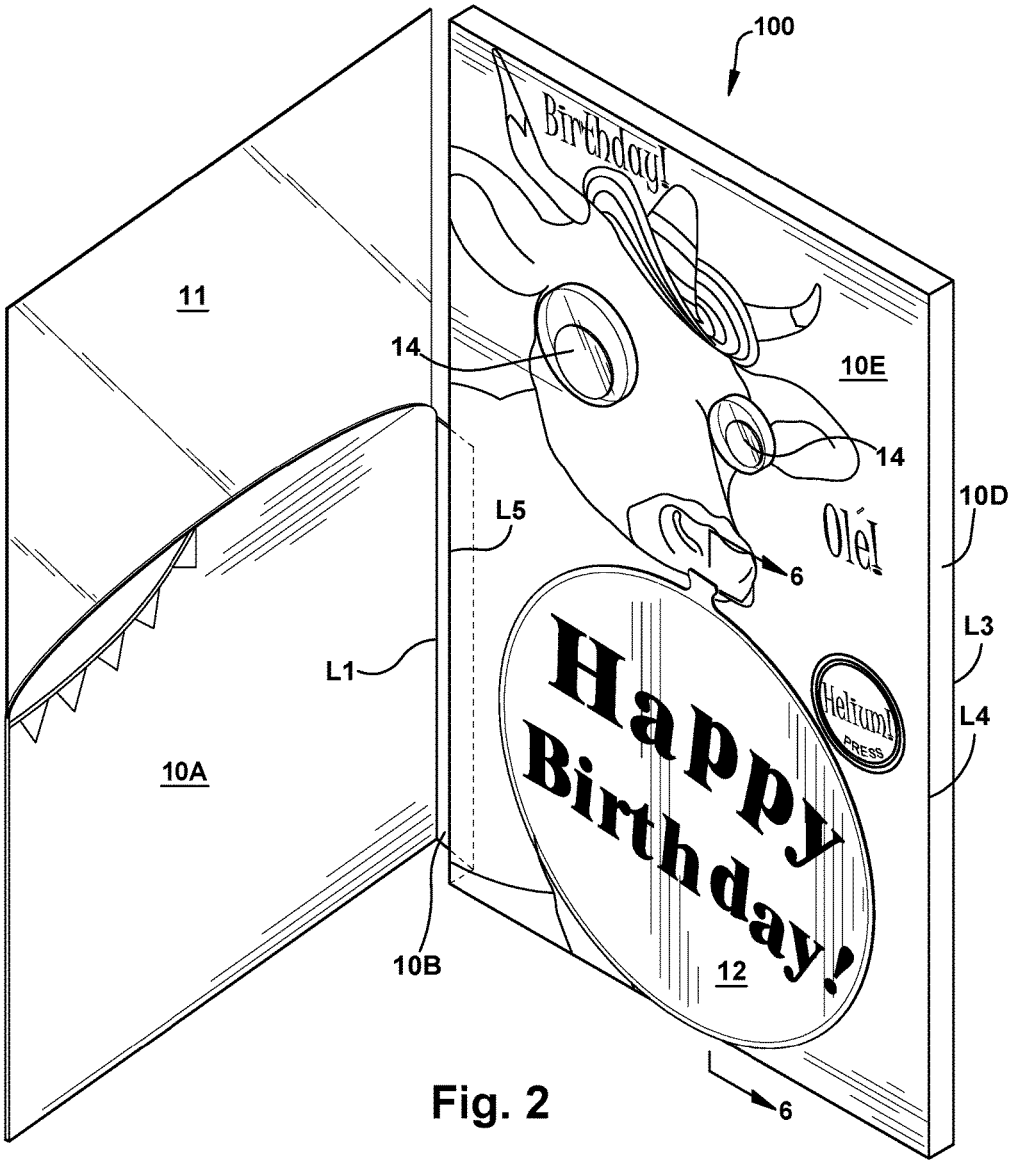
FIG. 2 is a perspective view of the GREETING CARD of FIG. 1, in an open position with deflated balloon.
Figure 3:
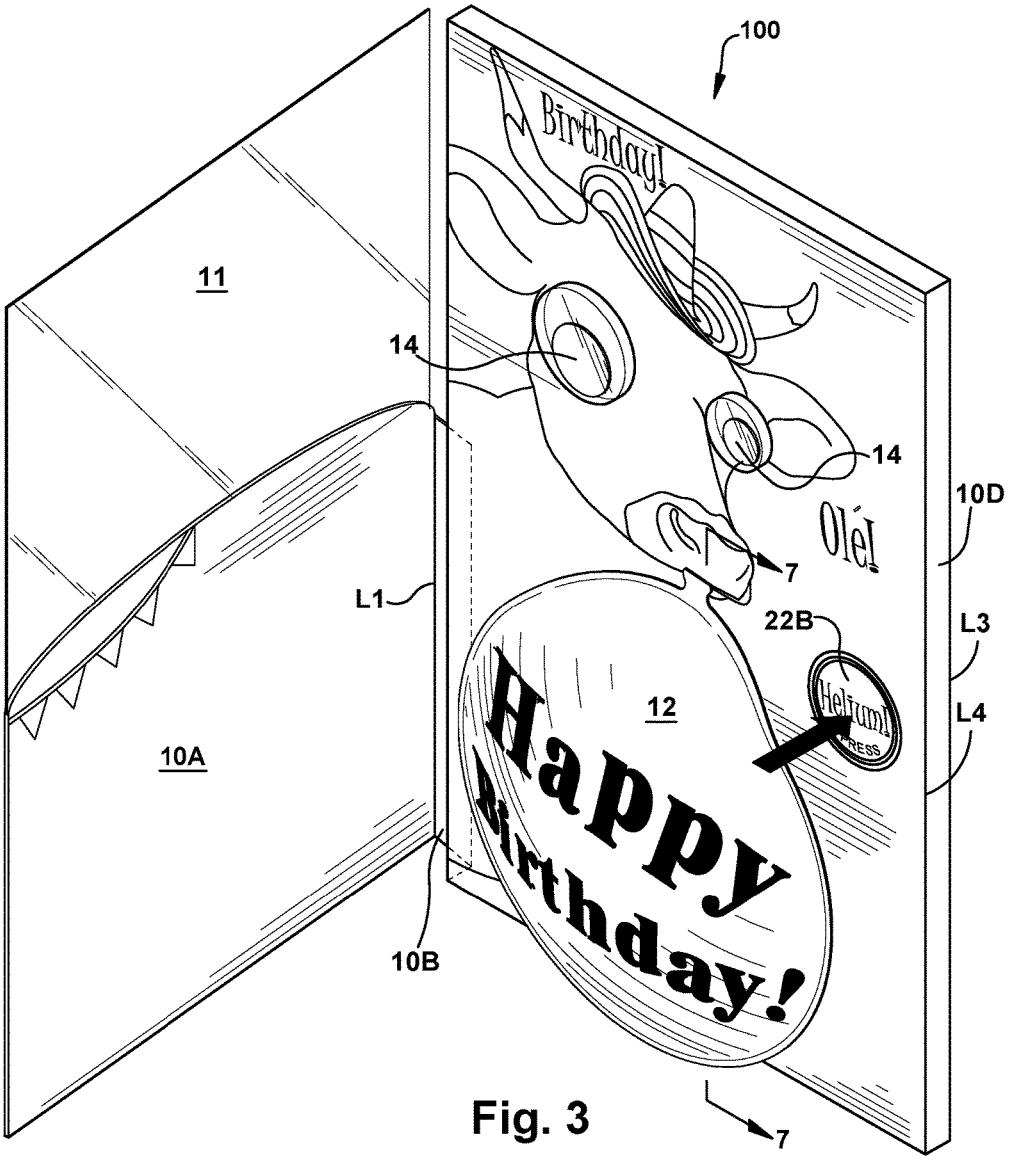
FIG. 3 is a perspective view of the GREETING CARD of FIG. 1, in an open position with inflated balloon.
Figure 6:
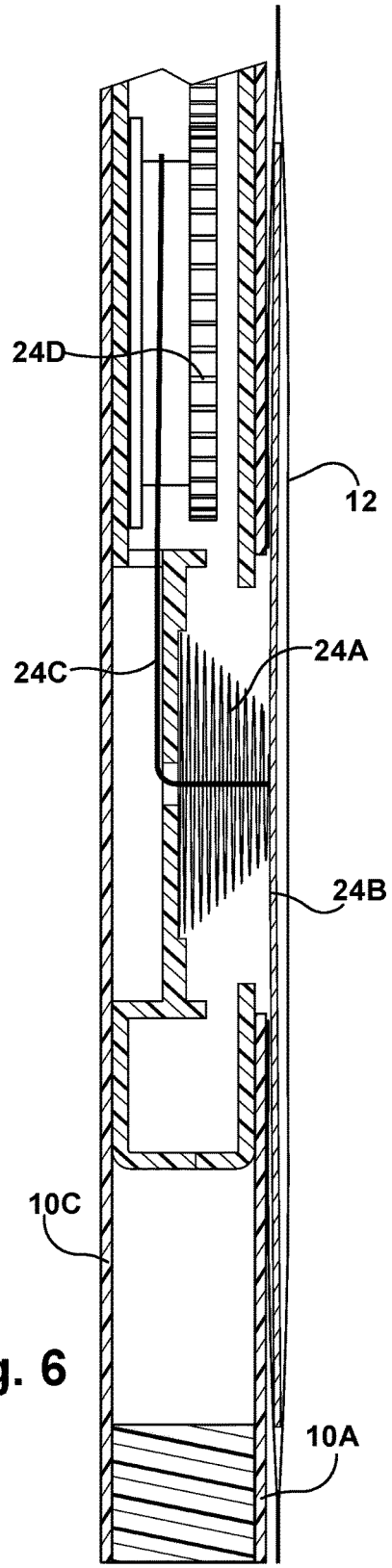
FIG. 6 is a cross-sectional view of the GREETING CARD of FIG. 2, from the perspective of arrows 6-6.
Figure 7:
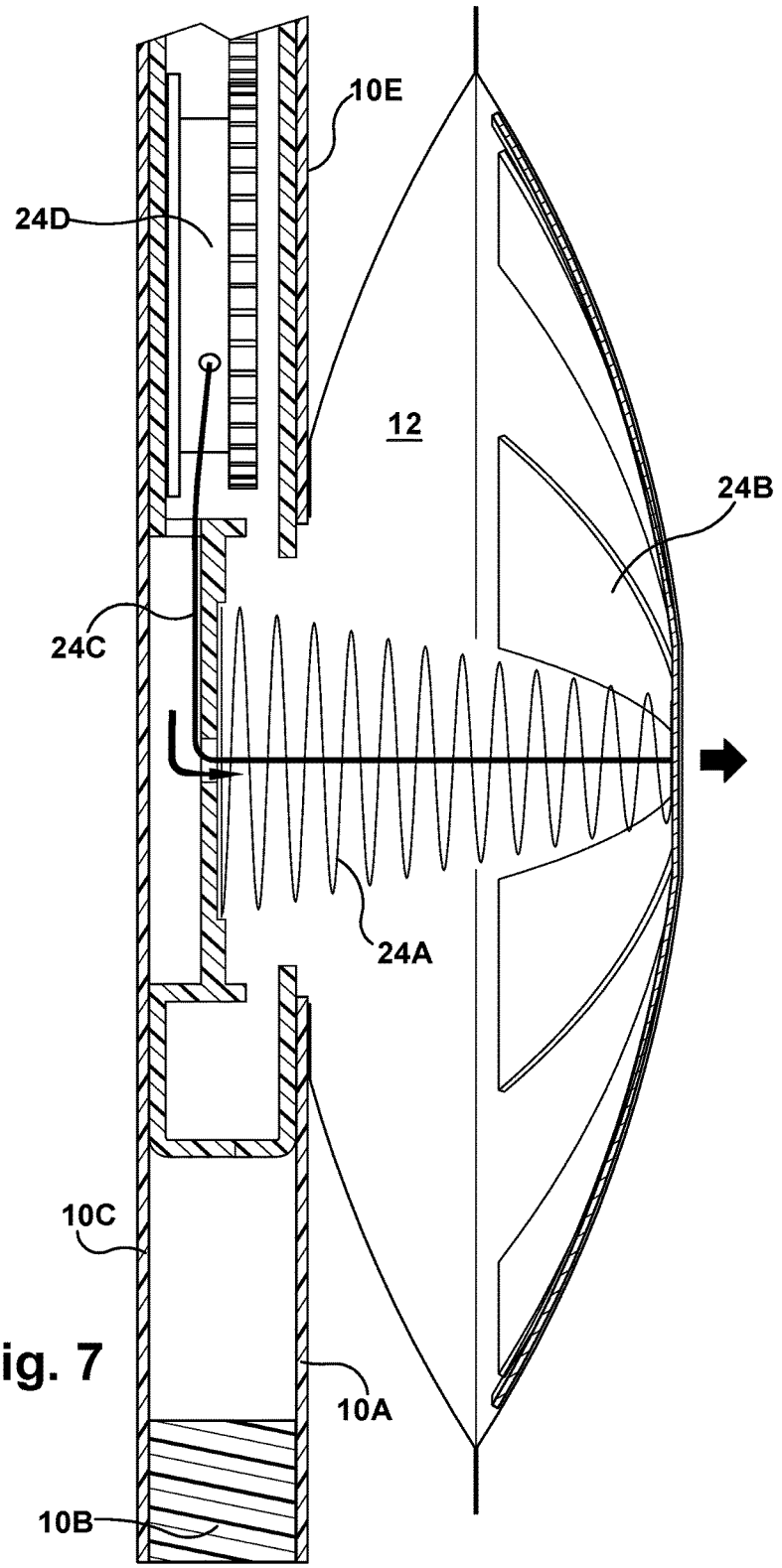
FIG. 7 is a cross-sectional view of the GREETING CARD of FIG. 3, from the perspective of arrows 7-7.

When the second switch 22B is activated by, in one embodiment, pushing the push button 22B, the motor 24E is activated and rotates in a first direction, causing the one or more gears 24 to turn, pushing the string 24C toward the spring 24A so that the spring can become fully uncoiled and push outward on the die cut shape 24B and inside front surface of the balloon 12, thereby inflating the balloon 12, as shown in FIGS. 3 and 7. The one or more gears 24 also cause the sliding mechanism 24F to move from a first position, depressing the first lever switch 24G (shown in FIG. 4) to a second position, depression the second lever switch 24G (shown in FIG. 5). When the sliding mechanism 24F is in the second position, it signals the motor 24E to stop turning in the first direction and begin turning a second direction. When the motor 24E turns in the second direction, the string 24C is pulled away from the spring 24A, causing the spring 24A to be pulled downward or depressed by the die cut shape 24B attached to the top thereof, thereby simulating deflation of the balloon 12, and returning the sliding mechanism 24F it's first, or original position, as shown in FIGS. 2 and 6.

In addition to inflating the balloon 12, the second switch 22B also causes the sound module to replay an audio clip through the speaker 16. As described above, the sound module initiates playback of a first audio clip through the speaker 16 upon opening the greeting card 100 via a first switch 22A. The first audio clip may instruct the user how to cause inflation of the balloon 12. When the user presses the press button 22B as instructed, the sound module initiates a second audio clip (in addition to activating the motor 24D as described above). The second audio clip may contain a song, music, singing, speaking, or any other audible sound. While the second switch 22B has been described herein and shown in the figures with respect to one embodiment as a press button switch, other switches may be used, including, but not limited to: a slide switch; a magnetic switch; a contact switch; a touch sensitive switch; a light sensitive switch; a toggle switch; a selector switch; a motion sensitive switch; or any other suitable switch.

In operation of one embodiment embodiment, when the user receives the greeting card 100, a picture of an animal printed on the third main greeting card panel (inside right side) 10E with a pair of googly eyes 14 attached thereto is visible when the greeting card 100 is in a closed position (due to the shorter nature of the front or first main greeting card panel 10A and optional transparent upper panel 11). Upon opening the greeting card 100 by moving or pivoting the front or first main greeting card panel 10A away from the rest of the greeting card, a first switch 22A initiates replay of a first audio clip, and the balloon 12, which is attached to the third greeting card panel (inside right panel) 10E beneath the printed animal picture, is revealed. The first audio clip may instruct the user how to cause the balloon 12 to inflate, such as by pressing the push button 22B. The first audio clip may additionally play music, give an oral greeting, sing a song, or replay other recordable sounds. When the user presses the press button 22B, the balloon 12 inflates, then pauses briefly, and then deflates. The user may subsequently press the press button 22B to repeat this action.

While the greeting card has been specifically described herein as having a particular number of greeting card panels with a particular size and shape, other numbers of greeting card panels with alternate shapes, sizes and configurations may be used. Also, while the particular placement of the balloon, switch, electronic components and printing has been described herein with respect to one embodiment, other embodiments may alternatively place these components in different locations. While two different switches (slide switch and push/press button switch) have been described with respect to one embodiment, as initiating first and second audio clips and initiating the faux inflation of the balloon, a single switch may be used to initiate both audio clips and faux inflation of the balloon, or different types of switches may be used in alternate embodiments. It should be understood that the greeting card has been described with respect to one embodiment, but changes in shape, size, configuration and placement of greeting card components can be made while still remaining within the scope of the present invention.

The foregoing embodiments of the present invention have been presented for the purposes of illustration and description. These descriptions and embodiments are not intended to be exhaustive or to limit the invention to the precise form disclosed, and obviously, many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a multi-panel greeting card body;

a balloon attached to the multi-panel greeting card body;

a mechanical spring located in an interior cavity of the balloon, the mechanical spring capable of moving from a first, substantially flat position to a second, upstanding position;

a switch which controls movement of the mechanical spring;

wherein closing the switch causes the mechanical spring to move from the first, substantially flat position to the second upstanding position within the interior cavity of the balloon, thereby simulating inflation of the balloon.

2. The greeting card of claim 1 further comprising a sound module operative to store and playback at least one audio file.

3. The greeting card of claim 2, wherein the switch also controls playback of the at least one audio file through a speaker.

4. The greeting card of claim 1, wherein the switch is a push button switch.

5. The greeting card of claim 1, wherein upon closing the switch the mechanical spring moves from the first to second position and back to the first position.

6. The greeting card of claim 1, wherein the balloon is attached to an inside panel of the greeting card.

7. The greeting card of claim 1, wherein the balloon is not visible when the greeting card is in a closed position.

8. A greeting card comprising:

a greeting card body;

a balloon attached to the greeting card body;

a mechanical mechanism located in an interior cavity of the balloon, the mechanical mechanism operative to move from a flat position to an upright position wherein it pushes outward on a front face of the balloon;

a switch which controls movement of the mechanical mechanism from the flat position to the upright position and back to the flat position.

9. The greeting card of claim 8, further comprising a sound module having at least two audio files saved thereon.

10. The greeting card of claim 9, further comprising a second switch which controls playback of a first audio file upon opening the greeting card.

11. The greeting card of claim 9, wherein the second switch is a slide switch or a magnetic switch.

12. The greeting card of claim 9, wherein the switch also controls playback of one of the at least two audio files.

13. The greeting card of claim 8, wherein the switch is a press button switch.

14. The greeting card of claim 8, wherein the switch is located proximate to the balloon.

15. The greeting card of claim 8, wherein the balloon is not visible when the greeting card is in a closed position.

16. A greeting card comprising:

a multi-panel greeting card;

a sound module contained inside the multi-panel greeting card body, the sound module operative to store and playback at least one audio file;

a mechanical balloon which is operative to move from a flat position to an inflated position;

a switch which controls activation of the sound module and movement of the mechanical balloon;

wherein upon closing the switch, the mechanical balloon moves from the flat position to the inflated position and back to the flat position.

17. The greeting card of claim 16, wherein upon closing the switch, the sound module plays back the at least one audio file through a speaker.

18. The greeting card of claim 16, wherein a second switch causes playback of a first audio file upon opening the greeting card.

19. The greeting card of claim 17, wherein the first audio file instructs the user on how to cause the mechanical balloon to become inflated.

* * * * *